US008376061B2

(12) United States Patent
Feenstra

(10) Patent No.: US 8,376,061 B2
(45) Date of Patent: Feb. 19, 2013

(54) FIRE PROTECTION SPRINKLER

(75) Inventor: Shawn J. Feenstra, Caledonia, MI (US)

(73) Assignee: The Viking Corporation, Hastings, MI (US)

( * ) Notice: Subject to any disclaimer, the term of this patent is extended or adjusted under 35 U.S.C. 154(b) by 478 days.

(21) Appl. No.: 12/431,990

(22) Filed: Apr. 29, 2009

(65) Prior Publication Data

US 2010/0276164 A1 Nov. 4, 2010

(51) Int. Cl.
*A62C 37/08* (2006.01)

(52) U.S. Cl. ..... 169/37; 169/39; 239/498; 239/518

(58) Field of Classification Search ..... 169/5, 17, 169/37–41, 90; 239/498, 501, 502, 504, 239/518, 522, 524
See application file for complete search history.

(56) References Cited

U.S. PATENT DOCUMENTS

| | | | | |
|---|---|---|---|---|
| 720,013 | A * | 2/1903 | Esty | 169/39 |
| 824,128 | A | 6/1906 | Martin | |
| 1,165,313 | A | 12/1915 | Bower | |
| 2,862,565 | A | 12/1958 | Dukes | |
| 3,525,402 | A | 8/1970 | Hattori | |
| 3,653,444 | A | 4/1972 | Livingston | |
| 3,682,251 | A | 8/1972 | Livingston | |
| 3,722,596 | A | 3/1973 | Livingston | |
| 3,743,022 | A | 7/1973 | Livingston | |
| 3,768,736 | A | 10/1973 | Cox | |
| 3,812,915 | A | 5/1974 | Livingston | |
| 3,888,313 | A | 6/1975 | Freeman | |
| 3,904,126 | A | 9/1975 | Allard | |
| 4,091,873 | A | 5/1978 | Werner | |
| 4,099,675 | A | 7/1978 | Wohler et al. | |
| 4,136,740 | A | 1/1979 | Groos et al. | |
| 4,279,309 | A | 7/1981 | Fischer et al. | |
| 4,296,815 | A | 10/1981 | Mears | |
| 4,296,816 | A | 10/1981 | Fischer | |
| 4,405,018 | A | 9/1983 | Fischer | |
| 4,580,729 | A | 4/1986 | Pounder | |
| 4,657,085 | A | 4/1987 | Jacobsen | |
| 4,800,961 | A | 1/1989 | Klein | |
| 4,901,799 | A | 2/1990 | Pepi et al. | |
| 4,930,578 | A | 6/1990 | Barnett et al. | |
| 5,036,923 | A | 8/1991 | Shea, Sr. | |
| 5,094,298 | A | 3/1992 | Polan | |
| 5,152,344 | A | 10/1992 | Fischer et al. | |
| 5,366,022 | A | 11/1994 | Meyer et al. | |

(Continued)

FOREIGN PATENT DOCUMENTS

| | | |
|---|---|---|
| WO | 98/18525 | 5/1998 |

*Primary Examiner* — Len Tran
*Assistant Examiner* — Justin Jonaitis
(74) *Attorney, Agent, or Firm* — Harness, Dickey & Pierce, P.L.C.

(57) ABSTRACT

A fire protection sprinkler is provided with a sprinkler body having a fluid passage defining an inlet end and an outlet end. A plug member is disposed in the fluid passage and a heat responsive unit releasable secures the plug member and the passage. A deflector is mounted to frame arms extending from the sprinkler body and the deflector includes a peripheral edge including a plurality of slots extending radially inward from the peripheral edge. At least two of the plurality of slots have a first outer portion having a first diameter and a second intermediate portion adjacent the first outer portion and having a second diameter less than the first diameter. A third inner portion extends radially inward from the second intermediate portion and has a third diameter greater than the second diameter. The deflector design is utilized for providing a desired water distribution pattern.

32 Claims, 3 Drawing Sheets

U.S. PATENT DOCUMENTS

| | | | | | |
|---|---|---|---|---|---|
| 5,579,846 | A | | 12/1996 | Meyer et al. | |
| 5,584,344 | A | * | 12/1996 | Meyer et al. | 169/37 |
| 5,609,211 | A | | 3/1997 | Meyer et al. | |
| 5,664,630 | A | | 9/1997 | Meyer et al. | |
| 5,687,914 | A | | 11/1997 | Bosio et al. | |
| 5,829,532 | A | | 11/1998 | Meyer et al. | |
| 5,839,667 | A | | 11/1998 | Fishcer | |
| 5,862,994 | A | | 1/1999 | Pounder et al. | |
| 5,865,256 | A | * | 2/1999 | Pounder | 169/37 |
| 5,890,657 | A | | 4/1999 | Ponte | |
| 5,915,479 | A | | 6/1999 | Ponte | |
| 6,026,907 | A | * | 2/2000 | Pahila | 169/37 |
| 6,059,044 | A | * | 5/2000 | Fischer | 169/37 |
| 6,502,643 | B1 | | 1/2003 | Meyer et al. | |
| 7,165,624 | B1 | | 1/2007 | Fischer | |
| 2007/0114047 | A1 | | 5/2007 | Fischer | |
| 2009/0078432 | A1 | * | 3/2009 | Tow et al. | 169/37 |

* cited by examiner

FIRE PROTECTION SPRINKLER

FIELD

The present disclosure relates to a fire protection sprinkler, and more particularly to a fire protection sprinkler having a deflector design for providing a desired water distribution pattern.

BACKGROUND AND SUMMARY

This section provides background information related to the present disclosure which is not necessarily prior art. It also provides a general summary of the disclosure, and is not a comprehensive disclosure of its full scope or all of its features.

Fire protection sprinklers are designed and widely used for commercial and residential applications to control or suppress a fire. In commercial applications there are environmental conditions that can dictate which types of sprinklers are utilized in the commercial environment. The commercial application can include a hazard type or commodity that is being stored in the commercial environment, the ceiling height, the height of storage that can be stacked on racks, the presence of obstructions, the coverage area needed to be protected, the spacing between the sprinkler heads and the available water supply. For residential applications, the coverage area, spacing, water supply, ceiling type, as well as other aesthetic concerns may apply. The National Fire Protection Association (NFPA) provides standards that define the minimum requirements for the designing and installation of automatic fire sprinkler systems. One type of fire protection system is a fire suppression system in which the sprinkler system is designed to sharply reduce the heat release rate of a fire and prevent its re-growth by means of direct and sufficient application of water or other fire suppressant through the fire plume to the burning fuel source. A fire control system is designed to limit the size of a fire by distribution of water so as to decrease the heat release rate and pre-wet adjacent combustibles while controlling ceiling gas temperatures to avoid structural damage. The NFPA provides different standards for fire suppression and fire control.

Both Underwriters Laboratories (UL) and Factory Mutual (FM) approvals provide fire testing of sprinkler designs for meeting their intended design purpose. For successful fire suppression or control tests performed at Underwriters Laboratory or Factory Mutual, the tests provide baseline data for water distribution and response time requirements for future designs intended to meet the same design requirements. The baselines are used to establish water distribution requirements for testing of the future sprinklers and these baseline water distribution requirements are determined based upon water distribution tests of the sprinkler heads that were tested to successfully control or suppress a fire as required. The sprinkler characteristics that are important for meeting design requirements typically include the required delivered density (RDD), the actual delivered density (ADD), the thermal sensitivity of the sprinkler, and the operating time of the sprinkler. In general, if a subsequently designed sprinkler has the same or improved water distribution in order to meet the required delivered density and actual delivered density requirements, and the sprinkler's thermal sensitivity and operating time are within the required limits, the sprinkler design can be approved without the necessity for conducting further actual fire tests which can be very expensive and time consuming.

Each different sprinkler type demands a different type of water spray pattern to achieve either fire control or suppression. Standard coverage ordinary hazard sprinklers generally protect a maximum coverage area of 130 square feet. According to the guidelines of the NFPA, extended coverage ordinary hazard sprinklers must protect from 225 to 400 square feet. Several factors can influence the water distribution patterns of a sprinkler. The different spray patterns achieved by different sprinkler types are provided by varying such factors as the shape of the sprinkler frame, the K-factor, and the geometry of the deflector position below the frame for creating a spray pattern. For applications where more water is required for control or suppression, the K factor can be increased to meet the demand for additional water. In addition, the water supply pressure can also be increased or decreased to meet the demands. The deflector geometry is particularly significant since the deflector is the main component of the sprinkler assembly and to a great extent, defines the size, shape, uniformity, and water droplet size of the pattern. Often times, a new sprinkler design can be achieved by utilizing an existing deflector geometry and/or by making minor modifications to the lengths or widths of the slots provided in the deflector. However, with some sprinkler designs, a simple modification of existing deflector geometry does not adequately provide the water distribution pattern necessary for a desired application.

The present disclosure provides a fire protection sprinkler including a sprinkler body having a fluid passage extending therethrough, the fluid passage having an inlet end and an outlet end. A plug member is disposed in the fluid passage and is releasably secured therein by a heat responsive unit. A frame arm extends from a sprinkler body and a deflector is mounted to the frame arm. The deflector includes a peripheral edge including a plurality of slots extending radially inward from the peripheral edge and with at least two of the plurality of slots having a first outer portion having a first diameter, a second intermediate portion adjacent the first outer portion and having a second diameter less than the first diameter and a third inner portion radially inward from the second intermediate portion and having a third diameter greater than the second diameter. With this design, a water distribution pattern can be achieved that meets the desired application.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
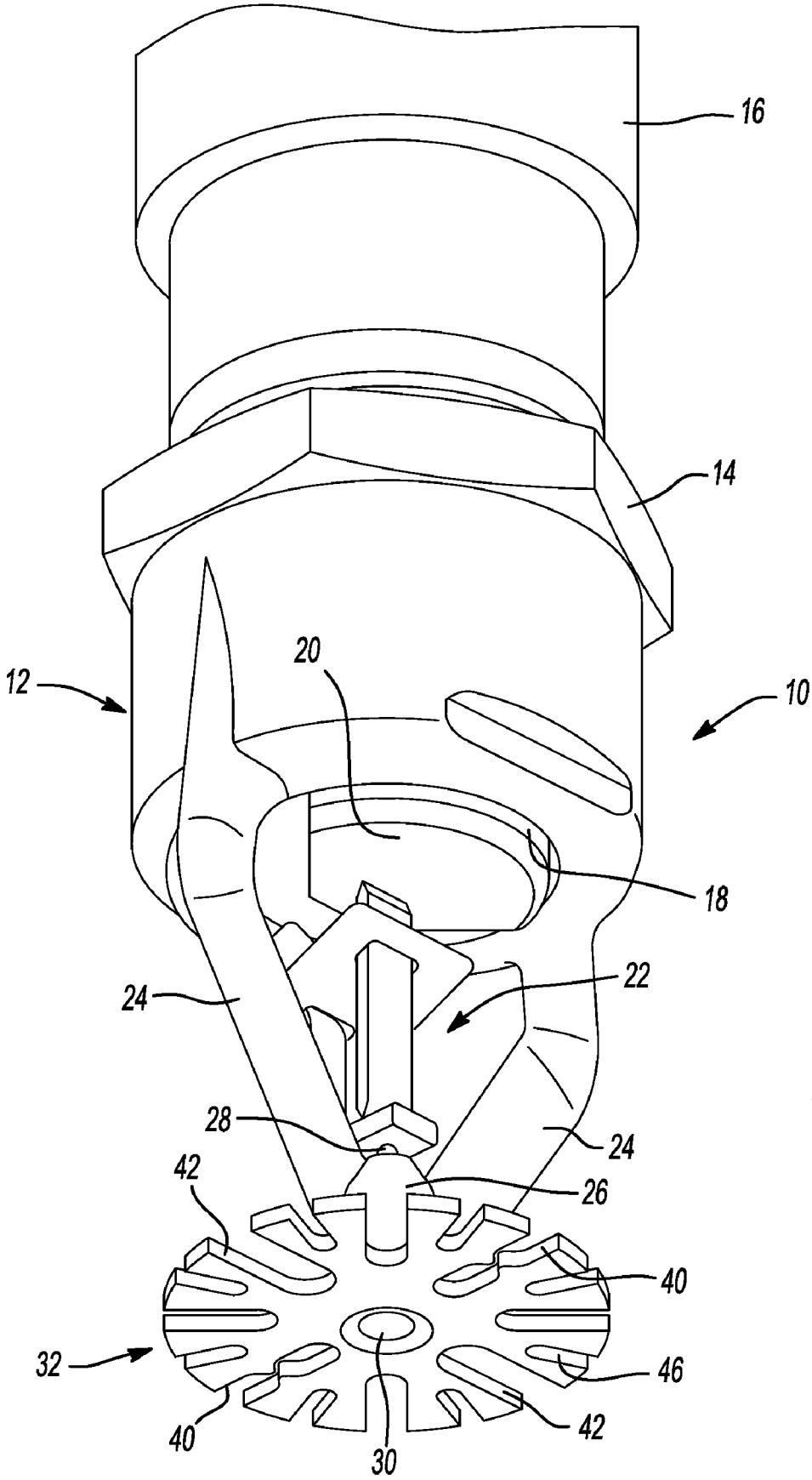
FIG. 1 is a perspective view of a fire protection sprinkler according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 2:
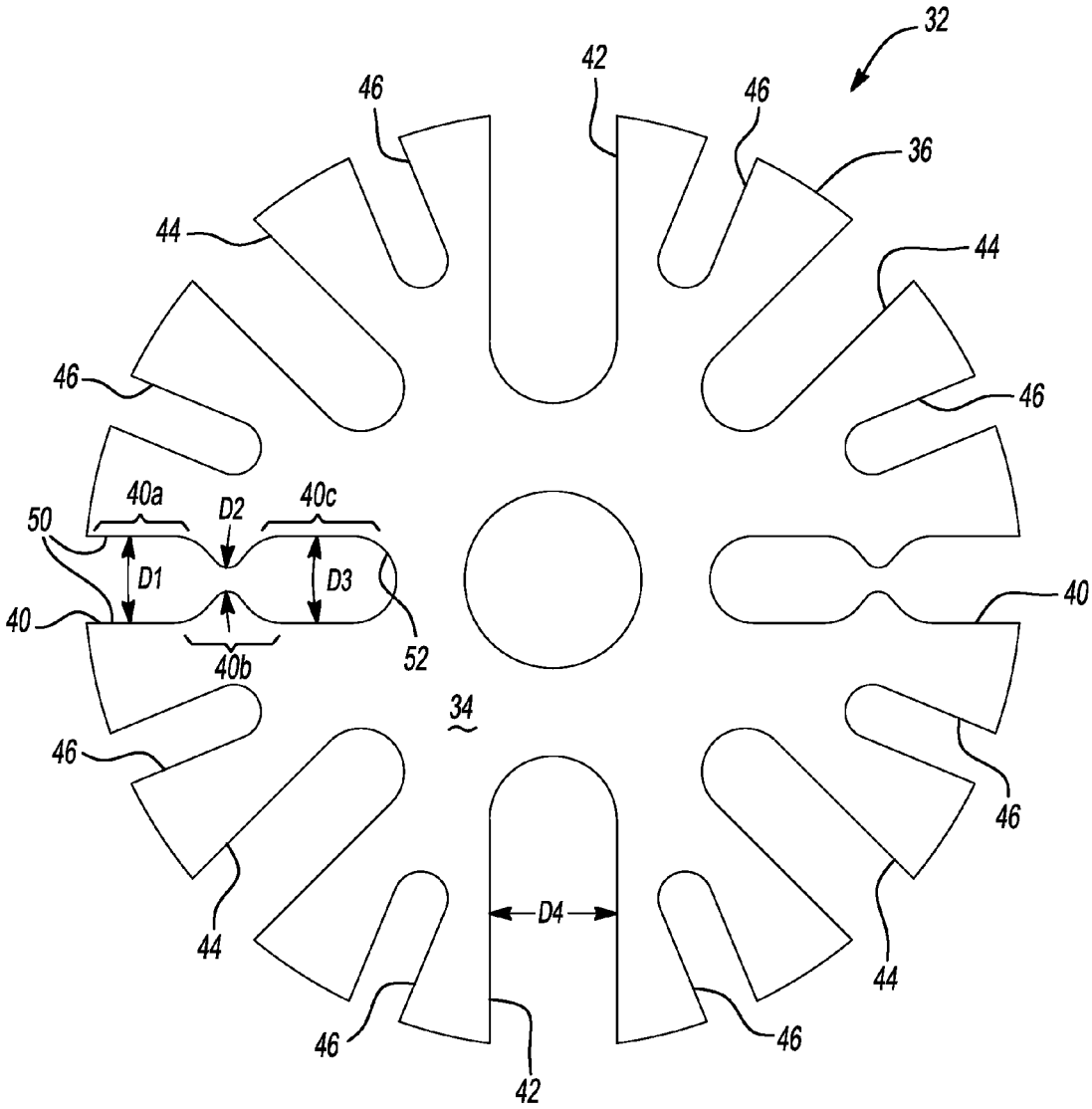
FIG. 2 is a plan view drawn to scale of a deflector for use with a fire protection sprinkler shown in FIG. 1.

With reference to FIGS. 1 and 2, the fire protection sprinkler, according to the principles of the present disclosure, will now be described. The fire protection sprinkler 10 includes a sprinkler body 12 having a fluid passage extending therethrough, the fluid passage having an inlet end 14 adapted for connection with a fluid piping system 16, and an outlet end 18. A plug member 20 is disposed in the fluid passage and is releasably secured therein by a heat responsive unit 22. A pair of frame arms 24 extend from the sprinkler body 12 and can terminate at an apex 26. The heat responsive unit 22 extends between the plug member 20 and a set screw 28 that is threadedly inserted through a threaded aperture 30 in the apex 26. A deflector 32 is mounted to the apex 26.

With reference to FIG. 2, the deflector 32 will now be described in greater detail. The deflector 32 can be formed from a flat plate 34, although other shapes that are non-planar can be utilized. The deflector 32 includes a peripheral edge 36 and can include a plurality of opposed slot pairs 40, 42, 44, and 46 extending radially inward from the peripheral edge 36. A first pair of the plurality of slots 40 are provided with an outer portion 40*a* having a first diameter that can range from between 0.200 and 0.250 inches. A second intermediate portion 40*b* is adjacent to the first outer portion 40*a* and has a second diameter D2 which can range from between 0.080 and 0.125 and is less than the first diameter D1. An inner portion 40*c* is disposed radially inward from the intermediate portion 40*b* and has a third diameter D3 that can be between 0.200 and 0.250 and is greater than the second diameter D2. According to one aspect of the present disclosure, the third diameter D3 can be equal to the first diameter D1. Furthermore, the second diameter D2 of the intermediate portion 40*b* can be less than half of the first diameter D1 of the outer portion 40*a* as well as being less than half of the third diameter D3 of the inner portion 40*c*. According to one aspect of the present disclosure, the second diameter D2 of the intermediate portion 40*b* can be approximately one-third of the first diameter D1 or third diameter D3 of the outer and inner portions 40*a*, 40*c*, respectively. In the assembled position on the sprinkler 10, the deflector is arranged with the pair of slots 40 being orthogonal to the pair of frame arms 24, as illustrated in FIG. 1.

A second pair of the plurality of slots 42 are aligned with the frame arms 24 and can have a diameter D4 greater than the first diameter D1 of the outer portion 40*a* of the pair of slots 40. The pair of slots 40 extend radially inward to a greater extent than a remainder of the plurality of slots 42, 44, and 46. As illustrated in FIG. 2, the intermediate portions 40*b* of the slots 40 can be tapered from the outer portion 40*a* and inner portion 40*c*. It should be noted that the outer portion 40*a* and the inner portion 40*c* can be provided with parallel sidewall portions 50, 52, respectively. Furthermore, the intermediate portion 40*b* can be disposed generally at a midway portion along a length of the slots 40. The outer portion 40*a* can be longer or shorter than the intermediate portion 40*b* and similarly, the inner portion 40*c* can be longer or shorter than the intermediate portion 40*b* and/or the outer portion 40*a*, depending upon the particular design requirements of the sprinkler being used. It is used that according to one aspect of the present disclosure, the sidewalls of the slots 40 can be generally shaped like an hourglass. Furthermore, it should be noted that the deflector 32 can be circular, oval, rectangular, or any other desired shape that achieves a desired water distribution pattern. The slot pairs 44 can be offset 45 degrees from the frame arms 24. The slot pairs 44 can be shorter and narrower than the slots 42. The slots 46 can be offset 22.5 degrees from each of the slots 44 and can be shorter and narrower than the slots 44, as illustrated. It should be noted that other slot arrangements can be used depending upon the specific application and that the slot widths and lengths can be changed to meet the desired water distribution pattern.

It is noted that the sprinkler body can have a nominal K-factor of 14, although larger and smaller K-factors can be utilized depending upon the application of the designed sprinkler 10. Furthermore, the heat responsive unit 22 can be designed to provide a response time index of less than 35, although other response time indexes exceeding 35 can be utilized depending upon a specific application. Applicants further note that the heat responsive unit 22 as shown is a linkage-type heat responsive unit which is well known in the art. It is contemplated that other heat responsive units can be utilized with the design of the present disclosure, as it is typically within the level of ordinary skill in the art for a sprinkler designer to modify a sprinkler to accommodate various types of existing heat responsive units in order to achieve desired heat sensitivity and response time indexes depending upon different applications. It should also be noted that the deflector of the present disclosure can be used with other sprinkler bodies that may or may not include frame arms as shown in the exemplary embodiment.

Figure 3:
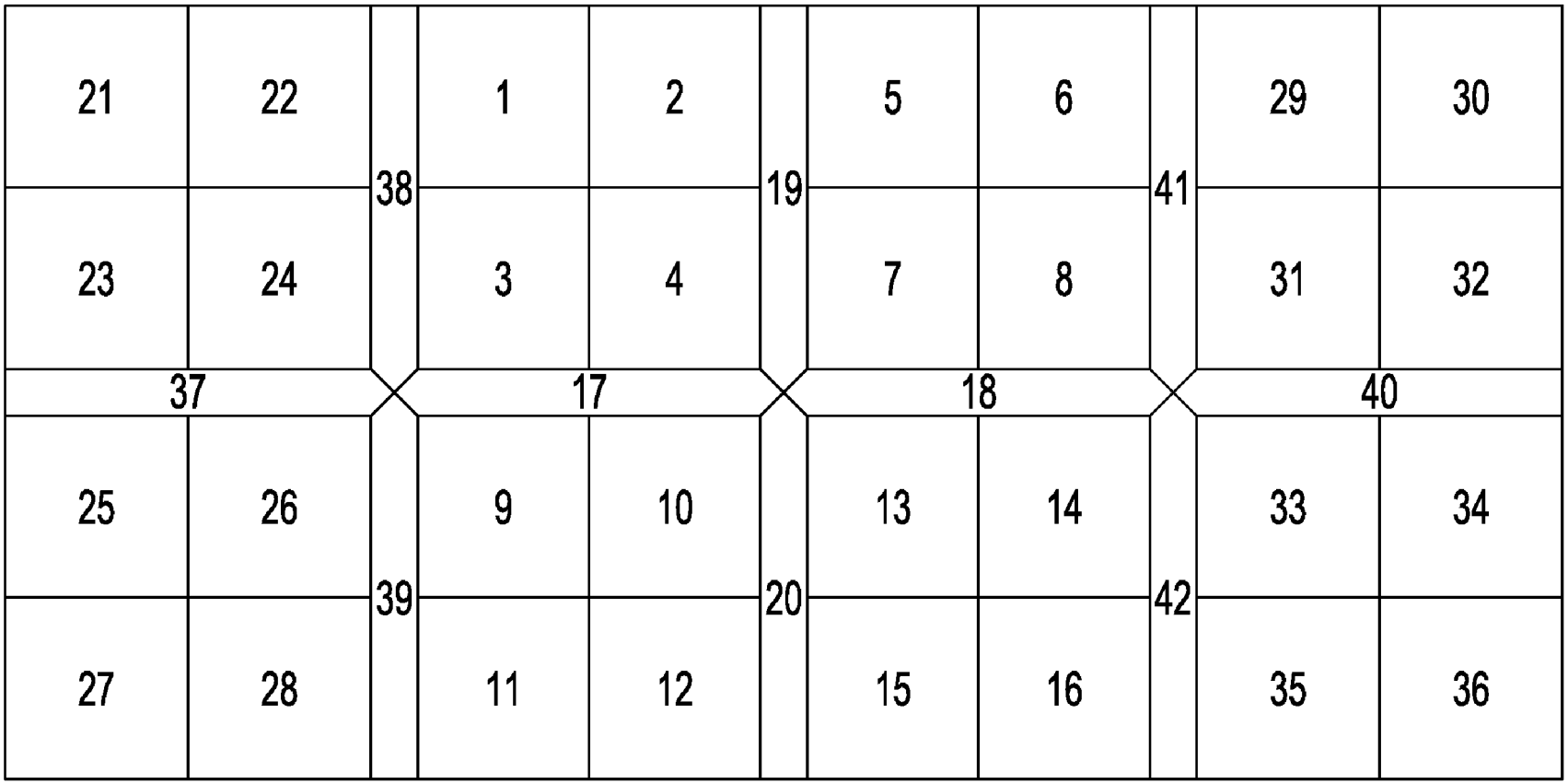
FIG. 3 illustrates a typical test layout of "buckets" which are utilized in the sprinkler design field for testing the water distribution pattern for a first protection sprinkler.

With reference to FIG. 3, the changes achieved utilizing the deflector 32, according to the principles of the present disclosure, will now be described. In the diagram of FIG. 3, a standard "bucket" layout is illustrated with each of the numbers 1-42 representing a different "bucket" of a test layout for determining the water distribution pattern of a given sprinkler head. In the illustration of FIG. 3, the sprinkler piping runs transversely over elongated buckets 19 and 20 with the sprinkler 10 installed over the junction of buckets 17, 18, 19, and 20. Other configurations of the piping and the sprinkler 10 can be used over these buckets for various tests. However, for purposes of the following explanation, the sprinkler piping again runs over buckets 19 and 20. The center area is defined by buckets 1-20. The flue spaces are defined as buckets 17-20 and the pre-wet areas are defined by buckets 21-42. The idea behind the present disclosure was to increase the flow into buckets 17 and 18 by reducing the flow to the pre-wet areas defined by buckets 21-40. In typical design processes, an alteration like this was typically done by opening the slot width and/or increasing the depth of the slots aligned with the buckets 17 and 18. However, when doing this, the flow of the pre-wet area was significantly reduced which caused testing failures in other piping configurations. The present disclosure reduces the flow to the pre-wet area, increases the flow to the flue spaces 17 and 18, and keeps the flow of water to the pre-wet areas strong enough to pass the testing for other pipe configurations. The benefit of the current design is also the increased flow into the center twenty buckets. Although not all twenty buckets receive the reduced water from the pre-wet area, the calculation of the center twenty average is enhanced.

The area of water flow reduction is found somewhat in buckets 23-26 and 31-34. The greatest impact was a 50 percent reduction in flow to buckets 37 and 40. The reduction in flow into buckets 37 and 40 does not reside in an increase of flow into buckets 17 and 18, but it spread also into buckets 3, 4, 7, 8, 9, 10, 13, and 14. The increase of flow into buckets 17 and 18 is about 20 percent. It is noted that each of the above comparisons are made relative to a deflector constructed similarly to deflector 32 without the reduced diameter intermediate portions 40*d* in the slots 40 of the deflector 32.

The foregoing description of the embodiments has been provided for purposes of illustration and description. It is not intended to be exhaustive or to limit the invention. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A fire protection sprinkler, comprising:

a sprinkler body having a fluid passage extending therethrough, said fluid passage having an inlet end and an outlet end;

a plug member disposed in said fluid passage;

a heat responsive unit releasably securing said plug member in said fluid passage;

at least one frame arm extending from said sprinkler body; and a deflector mounted to said at least one frame arm, said deflector including upper and lower planar surfaces and a peripheral edge including a plurality of slots extending radially inward from said peripheral edge, at least two of said plurality of slots having a first outer portion including a pair of parallel sidewall portions having a first diameter therebetween said pair of parallel sidewall portions being parallel in a direction that is also parallel to said upper and lower planar surfaces, a second intermediate portion adjacent said first outer portion and having a second diameter less than said first diameter and a third inner portion radially inward from said second intermediate portion and having a third diameter greater than said second diameter.

2. The fire protection sprinkler according to claim 1, wherein said third diameter is generally equal to said first diameter.

3. The fire protection sprinkler according to claim 1, wherein said second diameter is less than half of said first diameter.

4. The fire protection sprinkler according to claim 1, wherein said second diameter is less than half of said third diameter.

5. The fire protection sprinkler according to claim 1, wherein said second diameter is approximately one third of said first diameter.

6. The fire protection sprinkler according to claim 1, wherein said at least one frame arm includes a pair of frame arms, wherein said at least two of said plurality of slots are disposed opposite one another and are orthogonal to said pair of frame arms.

7. The fire protection sprinkler according to claim 6, wherein said deflector includes a pair of said plurality of slots aligned with said frame arms and having a diameter greater than said first diameter of said at least two of said plurality of slots.

8. The fire protection sprinkler according to claim 1, wherein said at least two of said plurality of slots extend radially inward to a greater extent than a remainder of said plurality of slots.

9. The fire protection sprinkler according to claim 1, wherein said second intermediate portion is tapered from said first outer portion and said third inner portion.

10. The fire protection sprinkler according to claim 1, wherein said first outer portion has parallel sidewall portions.

11. The fire protection sprinkler according to claim 1, wherein said third inner portion has parallel sidewall portions.

12. The fire protection sprinkler according to claim 1, wherein said second intermediate portion is disposed generally at a midway portion along a length of said at least two of said plurality of slots.

13. The fire protection sprinkler according to claim 1, wherein said sprinkler body has a nominal K-factor of 14.

14. The fire protection sprinkler according to claim 1, wherein said heat responsive unit has a response time index of less than 35 $m/s^2$.

15. The fire protection sprinkler according to claim 1, wherein said deflector is circular.

16. The fire protection sprinkler according to claim 1, wherein said first outer portion is longer than said second intermediate portion.

17. The fire protection sprinkler according to claim 1, wherein said third inner portion is longer than said second intermediate portion.

18. A deflector for a fire protection sprinkler, comprising:

a deflector body including upper and lower planar surfaces and a peripheral edge including a plurality of slots extending radially inward from said peripheral edge, at least two of said plurality of slots having a first outer portion including a pair of parallel sidewall portions having a first diameter therebetween said pair of parallel sidewall portions being parallel in a direction that is also parallel to said upper and lower planar surfaces, a second intermediate portion adjacent said first outer portion and having a second diameter less than said first diameter and a third inner portion radially inward from said second intermediate portion and having a third diameter greater than said second diameter.

19. The deflector according to claim 18, wherein said third diameter is generally equal to said first diameter.

20. The deflector according to claim 18, wherein said second diameter is less than half of said first diameter.

21. The deflector according to claim 18, wherein said second diameter is less than half of said third diameter.

22. The deflector according to claim 18, wherein said second diameter is approximately one third of said first diameter.

23. The deflector according to claim 18, wherein said at least two of said plurality of slots extend radially inward to a greater extent than a remainder of said plurality of slots.

24. The deflector according to claim 18, wherein said second intermediate portion is tapered from said first outer portion and said third inner portion.

25. The deflector according to claim 18, wherein said first outer portion has parallel sidewall portions.

26. The deflector according to claim 18, wherein said third inner portion has parallel sidewall portions.

27. The deflector according to claim 18, wherein said second intermediate portion is disposed generally at a midway portion along a length of said at least two of said plurality of slots.

28. The deflector according to claim 18, wherein said deflector body is circular.

29. The deflector according to claim 18, wherein said first outer portion is longer than said second intermediate portion.

30. The deflector according to claim 18, wherein said third inner portion is longer than said second intermediate portion.

31. A deflector for a fire protection sprinkler, comprising:

a deflector body including a peripheral edge including upper and lower planar surfaces and a plurality of slots extending radially inward from said peripheral edge, at least two of said plurality of slots having a first outer portion including a first pair of opposing radially extending straight sidewall edges, a second intermediate portion radially inward from and adjacent said first outer portion and having a pair of opposing projections extending toward each other and away from said first pair of opposing straight sidewall edges, and a third inner portion radially inward from said second intermediate portion and including a second pair of opposing straight sidewall edges, said second pair of opposing straight sidewall portions being spaced from one another by a distance greater than said pair of opposing projections of said second intermediate portion, said first and second pairs of opposing straight sidewall edges being planar in a direction perpendicular to said upper and lower planar surfaces.

32. The deflector according to claim 31, wherein said first pair of opposing straight sidewall edges are parallel and said second pair of opposing straight sidewall edges are parallel.

* * * * *